United States Patent [19]

Lewis

[11] 4,125,913

[45] Nov. 21, 1978

[54] MULTIPURPOSE TUBE WRENCH

[76] Inventor: Lawrence J. Lewis, 760 W. Alameda, #18, Pocatello, Id. 83201

[21] Appl. No.: 845,866

[22] Filed: Oct. 27, 1977

[51] Int. Cl.[2] ..... B25B 13/00

[52] U.S. Cl. ..... 7/138; 7/165; 81/121 R; 81/125.1; 145/50 C

[58] Field of Search ..... 7/138, 165; 81/71, 900, 81/120, 177 D, 53 R, 121 R, 125.1; 145/50 C

[56] References Cited

U.S. PATENT DOCUMENTS

| | | | |
|---|---|---|---|
| 619,553 | 2/1899 | Fox | 81/71 UX |
| 1,717,241 | 6/1929 | Moritsky | 7/138 X |
| 2,434,660 | 1/1948 | Knight | 81/53 R X |
| 2,527,492 | 10/1950 | Cleary et al. | 145/50 C |
| 4,056,020 | 11/1977 | Coviello | 145/50 C X |

FOREIGN PATENT DOCUMENTS

| | | | |
|---|---|---|---|
| 110,624 | 4/1964 | Czechoslovakia | 81/71 |
| 605,666 | 6/1960 | Italy | 81/71 |
| 671,087 | 4/1952 | United Kingdom | 81/71 |

*Primary Examiner*—James L. Jones, Jr.
*Assistant Examiner*—James G. Smith
*Attorney, Agent, or Firm*—Daniel Jay Tick

[57] ABSTRACT

An elongated cylindrical handle has a diametrical bore formed therethrough intermediate the ends thereof. A shower arm wrench body of hollow cylindrical configuration has an inner diameter equal to the diameter of the handle and an outer diameter greater than the diameter of the handle and is internally threaded and extends coaxially with a first end of the handle. A plurality of planar strips are equiangularly spaced from each other and taper downward to a second, opposite, end of the handle from an area spaced from the second end. The second end is insertable into a gas log lighter flange for tightening such flange. An axial bore formed in the handle from the second end accommodates the stem of a log lighter valve and has a plurality of equiangularly spaced grooves formed therein at the second end of the handle. A torque handle of shaft-like configuration is releasably accommodated in the diametrical bore of the handle for applying a torque thereto.

2 Claims, 7 Drawing Figures

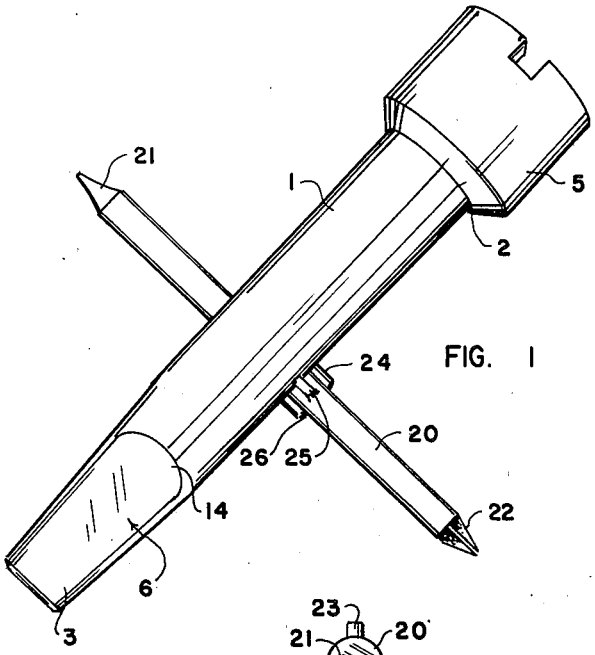
FIG. 1
FIG. 3
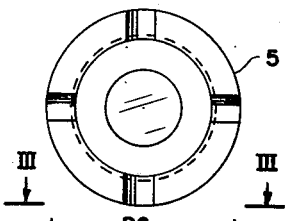
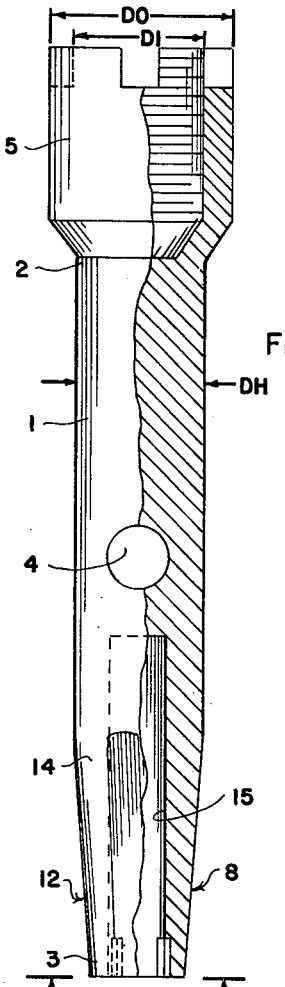
FIG. 2
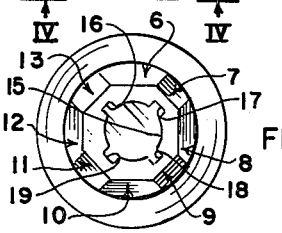
FIG. 4
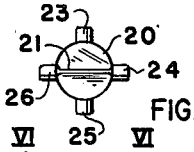
FIG. 6
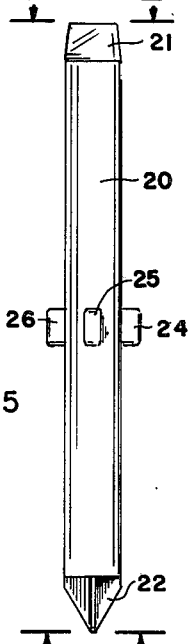
FIG. 5
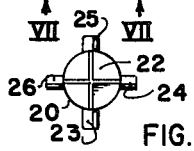
FIG. 7

MULTIPURPOSE TUBE WRENCH

BACKGROUND OF THE INVENTION

The present invention relates to a multipurpose tub wrench.

Objects of the invention are to provide a multipurpose tub wrench of simple structure, which is inexpensive in manufacture, used with facility, convenience and safety, and functions efficiently, effectively and reliably as a combination of tools for removing and inserting a bathtub drain strainer, removing and installing shower arms and preventing scratching of chrome finish, removing and installing gas log lighter flanges, and operation as a standard and as a Philips screwdriver.

BRIEF DESCRIPTION OF THE DRAWINGS

In order that the invention may be readily carried into effect, it will now be described with reference to the accompanying drawing, wherein:

FIG. 1 is a view of an embodiment of the multipurpose tub wrench of the invention;

FIG. 2 is a view, on an enlarged scale, partly cut away and partly in section, of the handle of the tub wrench of FIG. 1

FIG. 3 is an axial view, taken along the lines III—III, of FIG. 2;

FIG. 4 is an axial end view, taken along the lines IV—IV, of FIG. 2;

FIG. 5 is a view, on an enlarged scale, of an embodiment of the torque handle of the tub wrench of the invention;

FIG. 6 is an axial end view, taken along the lines VI—VI, of FIG. 5; and

FIG. 7 is an axial end view, taken along the lines VII—VII, of FIG. 5.

DETAILED DESCRIPTION OF THE INVENTION

The multipurpose tub wrench of the invention comprises an elongated substantially cylindrical handle 1 (FIGS. 1 and 2), having spaced opposite first and second ends 2 and 3 (FIGS. 1 and 2). The handle 1 has a diametrical bore 4 formed therethrough intermediate the ends thereof, as shown in FIG. 2.

A shower arm wrench body 5 (FIGS. 1 to 3) of hollow cylindrical configuration has an inner diameter DI (FIG. 2) substantially equal to the diameter DH of the handle and an outer diameter DO (FIG. 2) greater than the diameter of the handle. The wrench body 5 is internally threaded and extends coaxially with the first end 2 of the handle 1.

A plurality of planar strips 6, 7, 8, 9, 10, 11, 12 and 13 (FIG. 4) are equiangularly spaced from each other and taper downward to the second end 3 of the handle 1 from an area 14 (FIGS. 1 and 2) spaced from the second end. The second end 3 is insertable into a gas log lighter flange for tightening such flange.

An axial bore 15 (FIGS. 2 and 4) is formed in the handle 1 from the second end 3 for accommodating the stem of a log lighter valve. The axial bore 15 has a plurality of equiangularly spaced grooves 16, 17, 18 and 19 (FIG. 4) formed therein at the second end of the handle.

A torque handle 20 of shaft-like configuration, shown in FIGS. 1 and 5 to 7, is removably accommodated in the diametrical bore 4 of the handle 1, as shown in FIG. 1, for applying a torque thereto. The torque handle 20 has spaced opposite first and second ends 21 and 22 (FIGS. 1 and 5). A standard screwdriver blade is formed at the first end 21 of the torque handle 20, as shown in FIGS. 1 to 6. A pair of Philips screwdriver blades are formed at the second end 22 of the torque handle 20, as shown in FIGS. 1, 5 and 7.

A plurality of equiangularly spaced lugs 23, 24, 25 and 26 extend radially from the torque handle 20 intermediate the first and second ends 21 and 22 thereof, as shown in FIGS. 5 to 7. The lugs 23 to 26 are accommodatable in the grooves 16 to 19 formed in the second end 3 of the handle 1 whereby when the torque handle is to be used as a screwdriver, it is merely inserted into the bore 15 of said handle with the desired screwdriver blade extending therefrom and with the lugs 23 to 26 of the torque handle accommodated in the grooves of the elongated handle.

While the invention has been described by means of a specific example and in a specific embodiment, I do not wish to be limited thereto, for obvious modifications will occur to those skilled in the art without departing from the spirit and scope of the invention.

I claim:

1. A multipurpose tub wrench, comprising an elongated substantially cylindrical handle having spaced opposite first and second ends, said handle having a diametrical bore formed therethrough intermediate the ends thereof;

a shower arm wrench body of hollow cylindrical configuration having an inner diameter substantially equal to the diameter of the handle, said wrench body being internally threaded and extending coaxially with the first end of the handle;

a plurality of substantially planar strips equiangularly spaced from each other and tapering downward to the second end of the handle from an area spaced from the second end, said second end being insertable into a gas log lighter flange for tightening said flange, and an axial bore formed in the handle from the second end for accommodating the stem of a log lighter valve, the axial bore having a plurality of equiangularly spaced grooves formed therein at the second end of the handle; and a torque handle of shaft-like configuration removably accommodated in the diametrical bore of the handle for applying a torque thereto.

2. A multipurpose tub wrench as claimed in claim 1, wherein the torque handle has spaced opposite first and second ends, a standard screwdriver blade formed at its first end, a pair of Philips screwdriver blades formed at its second end, and a plurality of equiangularly spaced lugs extending radially from the torque handle intermediate the first and second ends thereof and accommodatable in the grooves formed in the second end of the elongated handle.

* * * * *